US005989174A

United States Patent [19]

Patrizio

[11] Patent Number: 5,989,174

[45] Date of Patent: Nov. 23, 1999

[54] AUTOMATIC MACHINE FOR FOLDING LONG SHEETS, PARTICULARLY TECHNICAL DRAWINGS

[75] Inventor: Caccia Patrizio, Ambivere, Italy

[73] Assignee: Neolt S.p.A., Ponte S. Pietro, Italy

[21] Appl. No.: 09/053,632

[22] Filed: Apr. 2, 1998

[51] Int. Cl.[6] ..... B31F 1/10; B65H 45/20

[52] U.S. Cl. ..... 493/413; 493/435; 493/445

[58] Field of Search ..... 493/413, 410, 493/411, 414, 415, 444, 445, 448, 430, 433, 435, 451, 454; 53/117, 120; 270/32; 271/225, 272, 266, 902; 192/48.9, 51, 84.21; 226/188

[56] References Cited

U.S. PATENT DOCUMENTS

| | | | |
|---|---|---|---|
| 622,579 | 4/1899 | Whitelaw | 493/413 |
| 1,283,108 | 10/1918 | Dexter | 493/413 |
| 3,724,838 | 4/1973 | Orlovsky | 270/79 |
| 4,059,258 | 11/1977 | Grantham | 270/67 |
| 4,061,327 | 12/1977 | Blessing | 270/78 |
| 4,084,391 | 4/1978 | Williams, Sr. et al. | 53/120 |
| 4,109,902 | 8/1978 | Barrer | 270/79 |
| 4,995,600 | 2/1991 | Kovac et al. | 270/45 |
| 5,169,376 | 12/1992 | Ries et al. | 493/445 |

FOREIGN PATENT DOCUMENTS

| | | | |
|---|---|---|---|
| 2139265 | 2/1973 | Germany . | |
| 3240627 | 5/1984 | Germany | 493/444 |

*Primary Examiner*—Joseph J. Hail, III
*Attorney, Agent, or Firm*—Steinberg & Raskin, P.C.

[57] ABSTRACT

An automatic machine for folding long sheets having first and second oscillating blades operating in a transverse motion to create alternate creases in a vertically descending sheet between a first and second upper folding rollers opposing respective first and second lower folding rollers that are rotatable with a predetermined reciprocating synchronous movement, said first and second oscillating blades being arranged to insert said sheet between said folding rollers to form folds in the sheet, whereby the folded sheet is directed towards an underlying collection shelf wherein said upper folding rollers being driven with rapid-reversal or pulse-reversal rotation by a linkage which moves them in the same direction by virtue of their connection by a toothed drive belt, engaged about their toothed end pulleys which are rotatably free, but which can be individually and alternately fixed to a shaft of their own respective roller following the operation of an electromagnetic clutch, said first upper folding roller being connected to said second upper folding roller by a series of gearwheels causing said first and said second upper folding rollers to rotate in opposite directions.

7 Claims, 8 Drawing Sheets

28
38
36
67
4A
6A
167
41
40
66
35
34
68
39
61
42
4B
5A
37
33
55
32
31
30
27
29

7
8
3
2
26
1

AUTOMATIC MACHINE FOR FOLDING LONG SHEETS, PARTICULARLY TECHNICAL DRAWINGS

FIELD OF THE INVENTION

This invention relates to an automatic machine for folding long paper sheets, particularly technical drawings.

BACKGROUND OF THE INVENTION

As is well known, the usually large dimensions of technical drawings makes it necessary to fold them into a size enabling them to be easily repositioned or partly opened out. Such folding must be done in a standardized manner to enable the folded sheets to be filed in an orderly way. This folding has previously been done manually by filing clerks. Currently there is a tendency to entrust it to specific sheet folding machines, which can carry out the operations in a more precise and rapid manner.

Currently known sheet folding machines are however particularly complex and costly, to the extent of being able to be acquired or used only by industries with large financial resources.

OBJECTS AND SUMMARY OF THE INVENTION

An object of the present invention is to define a sheet folding machine which enables said sheets to be folded in an economically achievable manner.

A further object is to define an automatically controlled sheet folding machine.

These and further objects will be seen to be achieved on reading the ensuing detailed description of a sheet folding machine characterised by creating the alternate folds by the action of two oscillating creasing blades prior to a short fold-completing compressing action determined by inserting a vertically descending and alternately creased sheet between two opposing pairs of presser rollers rotatable with predetermined reciprocating synchronous movement.

BRIEF DESCRIPTION OF THE DRAWINGS

The invention is illustrated by way of non-limiting example on the accompanying drawings, in which.

DETAILED DESCRIPTION OF THE PREFERRED EMBODIMENTS

Figure 1:
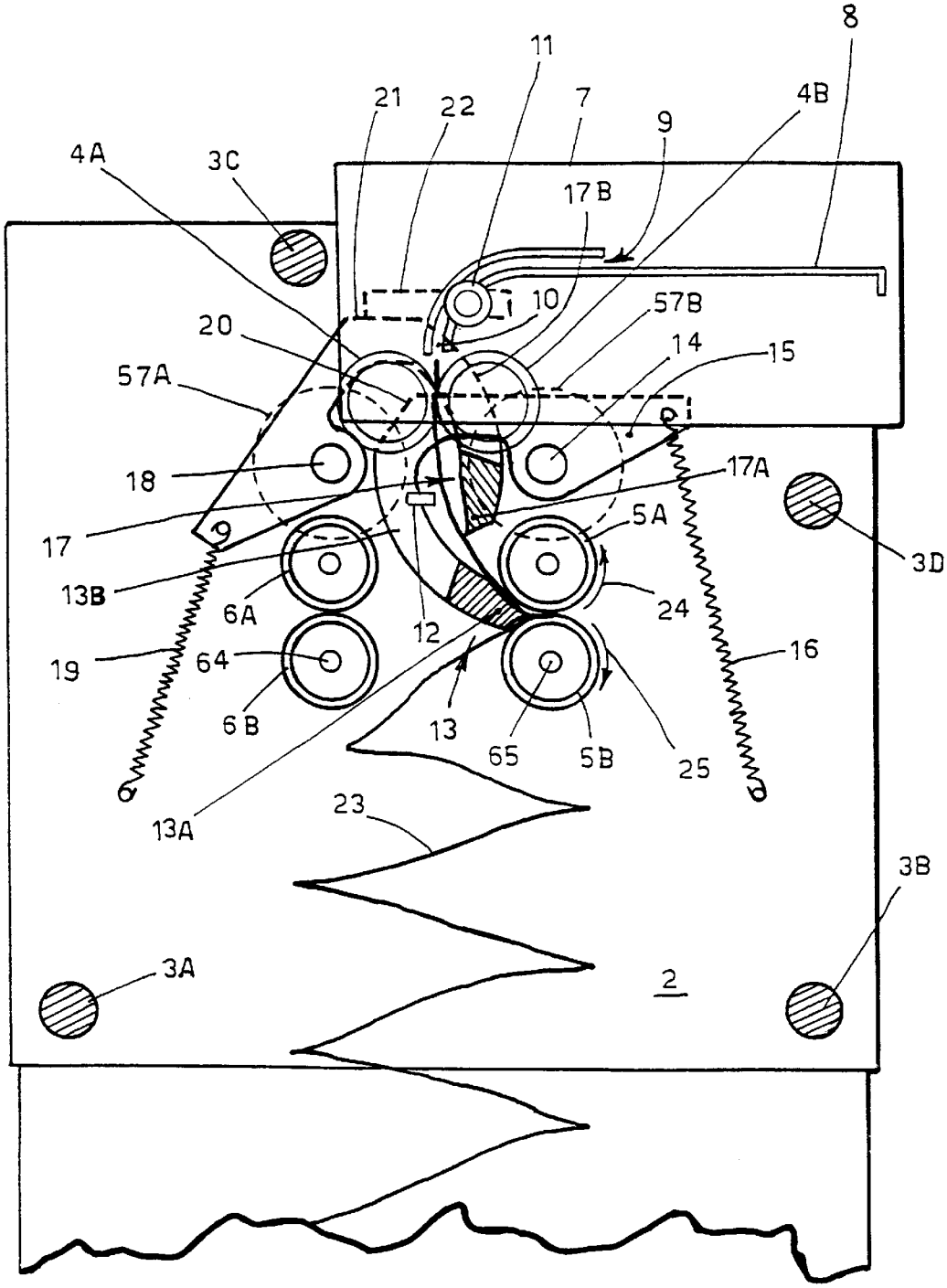
FIG. 1 is a schematic view of the mechanical operation of the machine.
Figure 6:
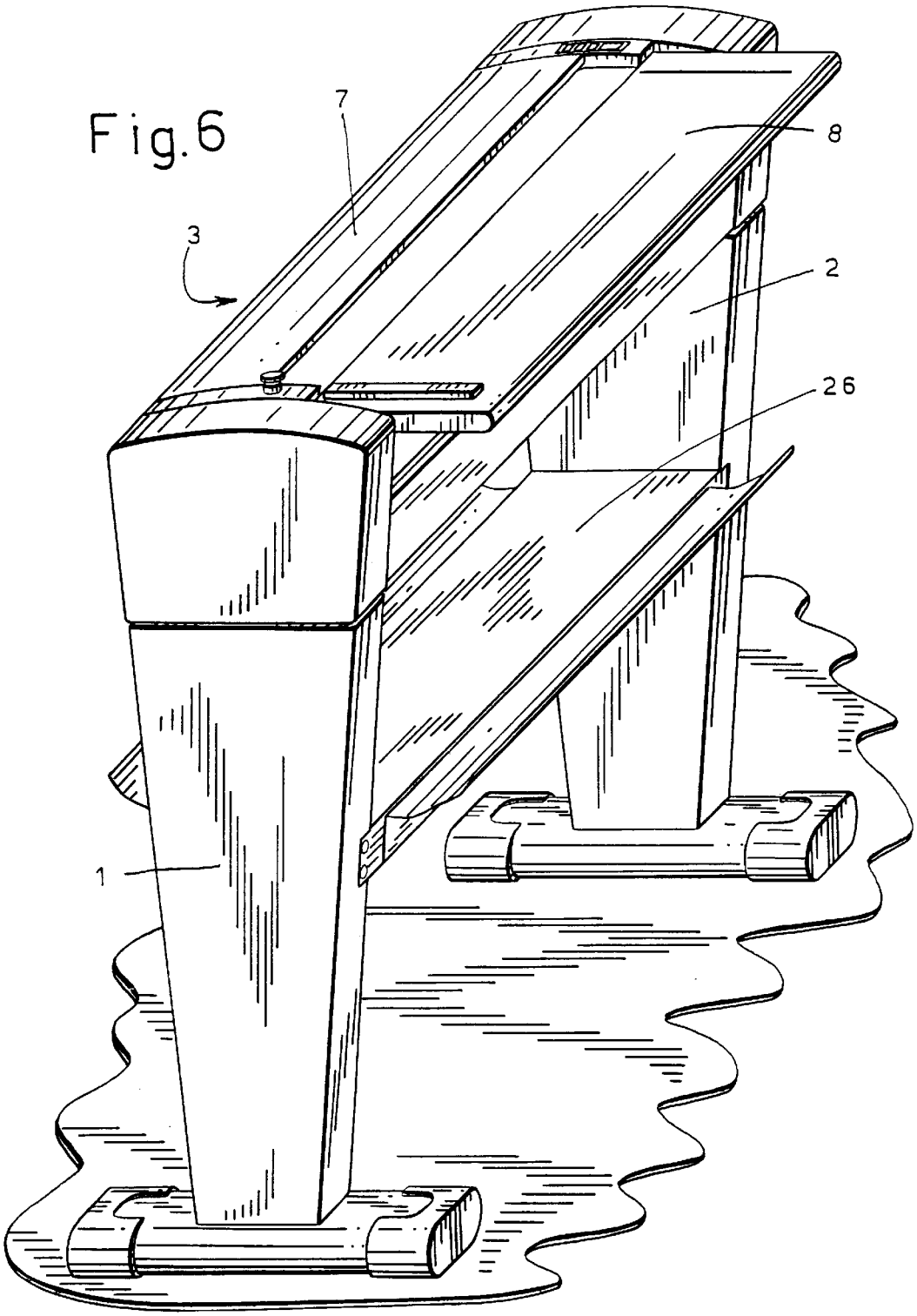
FIG. 6 is a perspective view of an embodiment of a sheet folding machine.

With reference to FIG. 6, the machine is structurally composed of a left sidepiece 1 and a right sidepiece 2 joined together by transverse stiffening elements 3, such as round bars 3A, 3B, 3C, 3D, shown in section in FIG. 1.

Said sidepieces 1 and 2 house roller and oscillating blade drive members.

Between said sidepieces there operate, along the entire distance between them, three pairs of rollers, namely a central sheet feed pair 4A, 4B, a front folding pair 5A, 5B and a rear folding pair 6A, 6B.

All these six rollers are externally rubber coated. The paper sheet is inserted between them to be dragged by friction by their accompanying engaging rotation.

The top of the machine comprises a transverse bench 7 including a testing surface 8, on which one side of the sheet to be folded is placed and on which it is slid manually until its insertion into a slot 9 which conveys it into vertical orientation via the end portion 10 of a 90° curve.

Within the slot 9 there operates an electronic proximity sensor 11 of encoder type, provided with a wheel rotated by the sliding of the paper sheet, so as to also provide a measurement of the length of the sheet inserted moment by moment, and usable by a microprocessor to establish the length of the fold and the position of the last fold to be formed, compatible with values selected via a keyboard.

The electronic sensor 11 activates the two dragging rollers 4A and 4B which, rotating in opposite directions, clamp a paper sheet 23 between them and feed it downwards. Following this, they inform a fold-initiation sensor 12 of the presence of this advancing sheet.

This sensor enables the appropriate times to be determined for operating a creasing blade 13 on the basis of the peripheral velocities of the rollers 4A–4B.

This blade, of suitable shape to avoid interfering with the other machine parts, oscillates about a shaft or pin 14. Its opposite end 15 is engaged with a return spring 16, which maintains its creasing part 13A (or blade tip or edge) in a rest position spaced front the sheet 23 to be folded.

This rest position is also assumed symmetrically by a further blade 17, pivoted at 18 and returned by a spring 19. Said rest position is established by abutment of the rear 20, 21 of a profiled lateral support member 13B, 17B of the blades 13 and 17 against a common fixed stop 22.

The arched shape of these lateral supports for the sharp creasing parts 13A, 17A of the blades 13 and 17 is necessary to prevent interference during their angular movements. For this reason they must operate in regions outside the longitudinal central portion in which the feed rollers 4A and 4B are present.

After the sharp creasing part 13A has formed a pre-fold in a sheet 23 by presenting it folded between the two front rollers 5A and 5B which rotate in the directions 24 and 25 with accompanying engagement, these rollers continue rotating only for the short time required to totally compress the pre-fold initiated by the sharp creasing part 13A of the blade.

After this, they reverse their direction of rotation to expel the folded part of the sheet, while the rollers 4A and 43 continue rotation to cause the sheet 23 to continue its downward descent.

After a predetermined extent of advancement and after the blade 13 has been returned to its rest position, the other blade 17 rotates to act with its creasing part 17A against that portion of the sheet 23 held between the two rollers 6A and 6B.

These rollers rotate such as to draw between them the opposite pre-fold formed by the sharp tip 17A, to compress said opposite fold and finally flatten it. This short stage is followed by expulsion of this folded region, enabling the sheet 23 being fed from above to descend downwards with this further definitive opposite fold, which causes it to assume the typical zig-zag or bellows profile. Hence, with fold following fold, the sheet 23 completely folded in the manner shown in FIG. 1, falls onto an underlying collection shelf 26 (FIG. 6).

As stated, the blades 13 and 17 are made to rotate through a certain angle to crease the sheet 23 between the respective rollers 5A–5B and 6A–6B, and to then return to an initial position defined by abutting against the stop 22. This angular rotation is determined by appropriate means, for example by the action of electromagnetic clutches or solenoid actuators.

Figure 8:
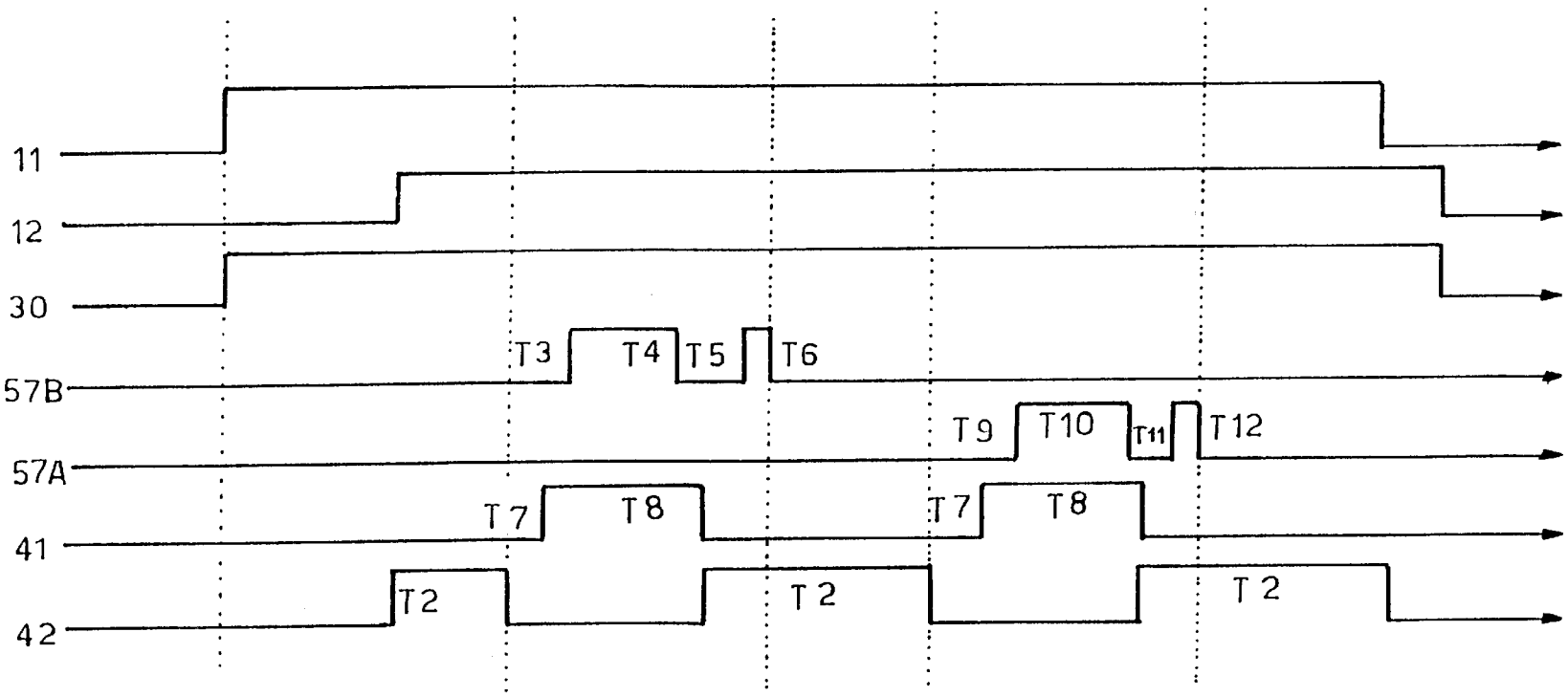
FIG. 8 is an example of a correlation diagram of the times of the various stages of the folding process.

This action occurs at a certain exact point in the cycle and continues for a certain exact time, in cooperation with the other parts of the machine, of which the diagram of FIG. 8 represents an example.

The creasing movement against the sheet by the blades 13 and 17 is synchronized with that by the respective pairs of rollers 5A–5B, 6A–6B which are required to reinforce this pre-fold by compressing it.

During this stage it is therefore necessary to cause the rollers 5A–5B and, alternately, the rollers 6A–6B to undergo short reverse rotational movements, to be followed by continuous rotation in the opposite direction to that which causes the folded sheet to be expelled from these pairs of rollers.

Figure 2:
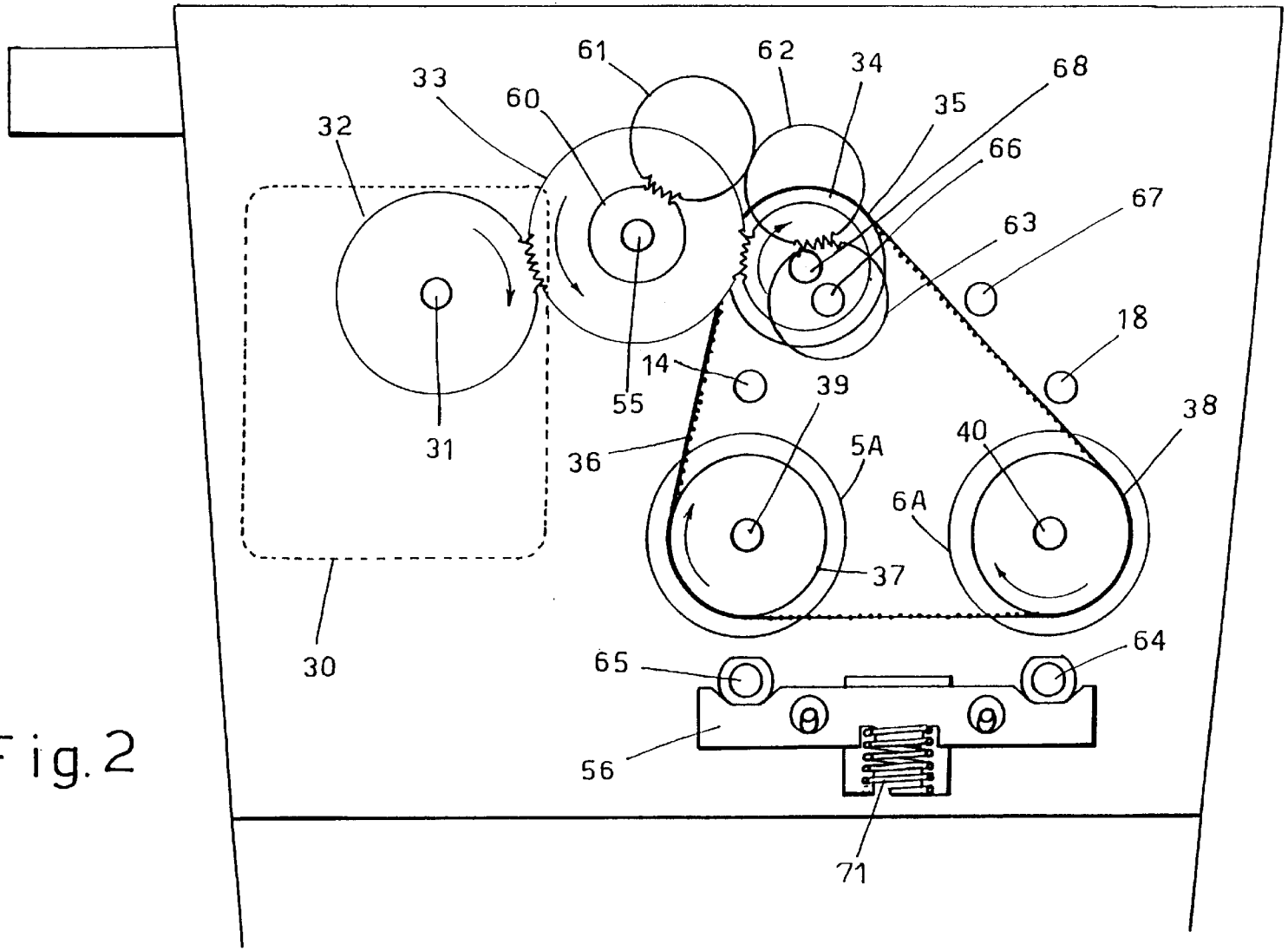
FIG. 2 is a side view of a motion transmission between an electric motor and two upper rollers of two reinforcing folding pairs, only the upper rollers of said pairs being shown for greater clarity.
Figure 3:
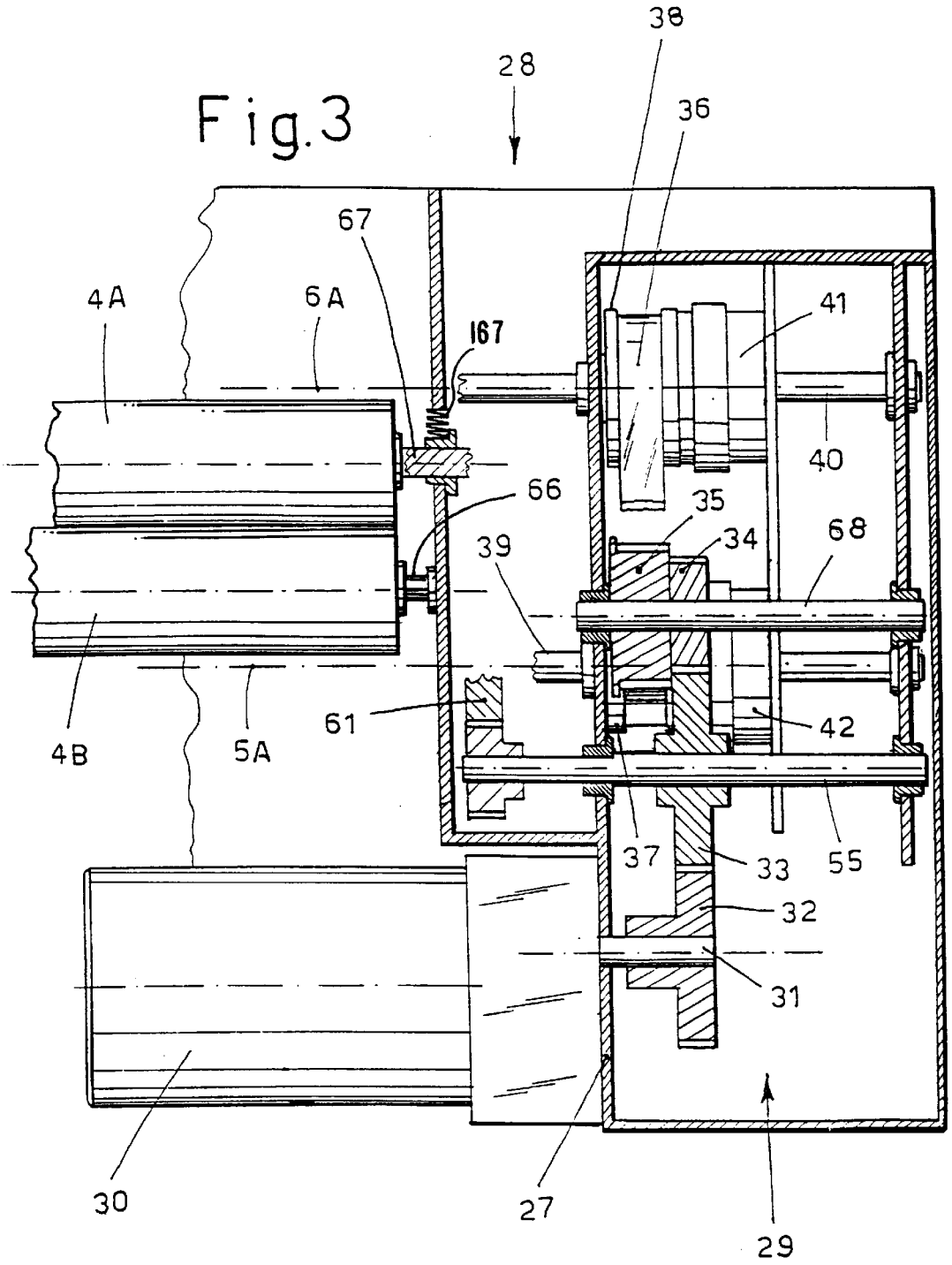
FIG. 3 shows a design arrangement of the aforesaid transmission in the form of a plan view from which parts have been omitted for greater clarity.

The linkages for this purpose are clear from the example shown in FIGS. 2 and 3.

FIG. 3, representing a plan view of the right sidepiece, shows the presence of an intermediate plate 27 acting as a vertical support upright. This plate substantially divides this right sidepiece into a central or inner part 28 and an outer part 29, and is required for accommodating suitable supports for the rotary members of horizontal axis required for the machine operation. Specifically, with reference to FIG. 2, the following takes place. An electric motor 30 operates a reduction gear comprising an output shaft 31. On this shaft there is keyed a gearwheel 32 engaging a gearwheel 33 on a shaft 55, this latter gearwheel engaging a further gearwheel 34. Gearwheel 63 directly drives feed roller 4B through a shaft 66 and the motion of gearwheel 66 is derived by transmitting rotational motion from gearwheels 32 and 33 via idle gearwheels 61 and 62. Feed roller 4A is elastically urged against feed roller 4B by a spring means 167, as indicated in FIG. 3, that applies a force at the support end of a shaft 67, which is connected to feed roller 4A, to thereby achieve contact between rollers 4A and 4B and generate the necessary dragging friction by means of a rubber coating present on both rollers. The transmission formed by the gear train 32, 33, 60, 61, 62, and 63 transmits motion to the shaft 66 of feed roller 4B.

On the shaft 68 of the gearwheel 34 there is keyed a toothed pulley 35 which by means of a conjugate toothed belt 36 drives pulleys 37 and 38 keyed on the shafts 39 and 40 respectively. The shafts 39 and 40 are those of the two upper folding rollers 5A and 6A respectively (FIG. 2).

Their drive is not direct, their respective toothed pulleys 37 and 38 being freely rotatable, ie idle, on them.

Figure 4:
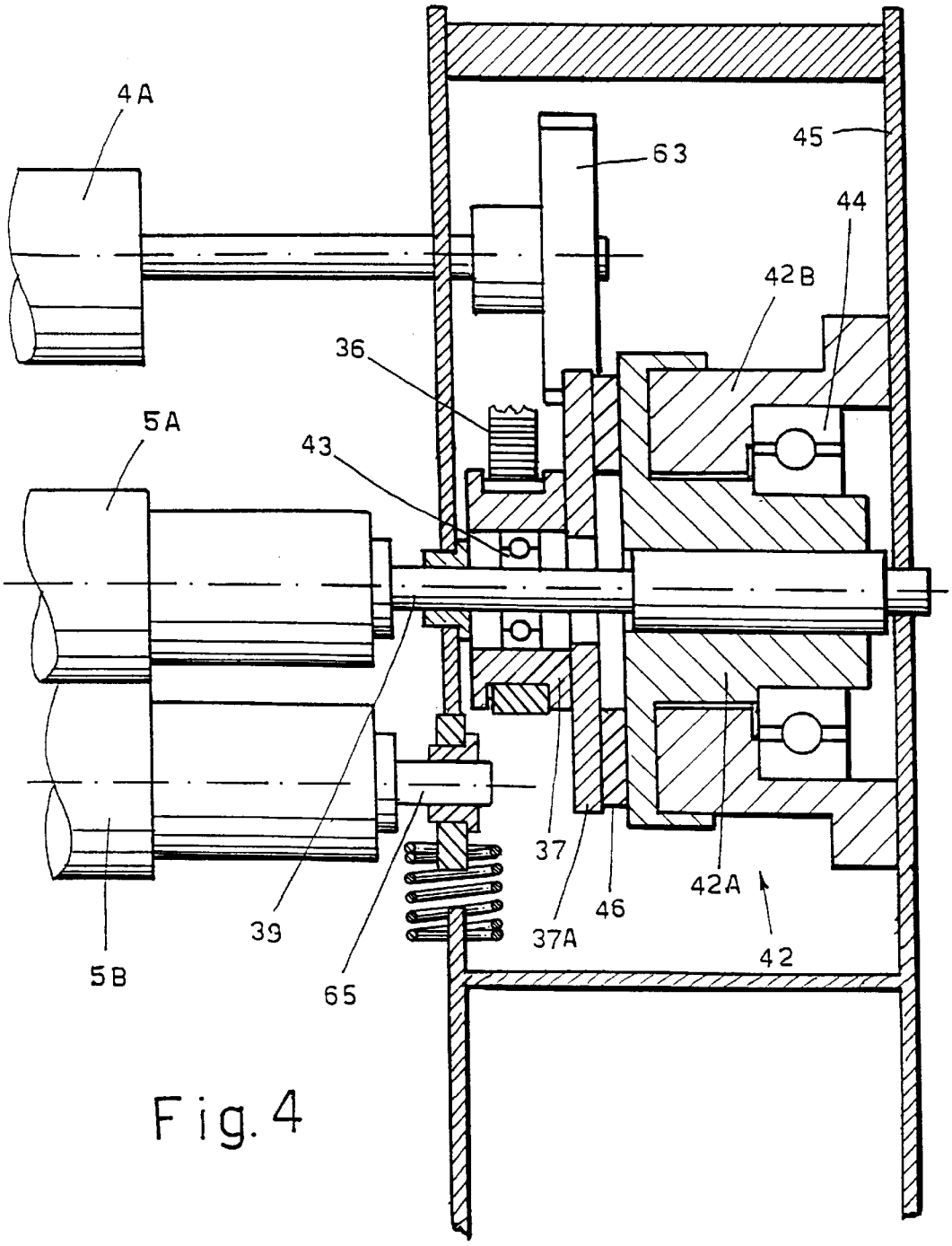
FIG. 4 shows the manner of operation of an electromagnetic clutch provided for controlling the upper rollers of the two pairs of folding rollers; more generally this clutch could also be used for reversing motion in any rotary shaft, such as the shaft which angularly drives the two said oscillating creasing blades.

In this respect their torsional engagement is achieved by the action of specific electromagnetic clutches 41 and 42, better seen in FIG. 4. In this it can be seen that the shaft 39 of the upper folding roller 5A is supported at one end by a bearing 44. The shaft 39 carries keyed onto one end the rotor part 42A of an electromagnetic clutch. The stator part 42B, fixed to a machine structural element 45, enables the rotor part 42A to rotate via the said bearing 44 interposed between the parts.

On a more inner region, the shaft 39 carries a rotatable support bearing 43 for the toothed pulley 37, driven in accordance with the scheme of FIG. 2.

Hence, although the electric motor 30 rotates the pulley 37 by its toothed belt 36, the roller 5A remains at rest. In this respect, this roller is made rigid with the pulley 37 by the operation of the electromagnetic clutch 42. By means of the typical force of magnetic attraction exerted on an iron disc 37A rigid with the pulley 37, said clutch enables a typical interposed friction element 46 to be clamped to render the pulley 37 or its iron disc 37A rigid with the rotor part 42A keyed on the shaft 39 of the roller 5A.

The aforesaid is likewise valid for the other upper folding roller 6A.

In this respect, these rollers are driven only when the clamping action of their own clutch 41 or 42 acts. For design rather than conceptual reasons, the clutch 42 is larger than the clutch 41. The upper folding rollers 5A and 6A are rigidly linked by a series of gears, visible in FIG. 5.

More precisely, the roller 5A carries a gearwheel 47 which engages a gearwheel 48 engaging a further identical gearwheel 49 which engages another gearwheel 50 rigid and coaxial with the roller 6A.

On the basis of this positive linkage between the parts, a hypothetical direction of rotation 51 of the roller 5A causes the gearwheel 48 to rotate in a rotational direction 52 causing the gearwheel 49 to rotate in a rotational direction 53, in turn causing gearwheel 50 to rotate in rotational direction 54.

It can be seen that the rotational direction 54 is the opposite of the rotational direction 51. However these rotations assume that one of the two rollers 5A or 6A is rotated by the motor via the dragging action of its specific electromagnetic clutch (FIG. 4).

The said linkage between the two upper folding rollers 5A and 6A is implemented on the other side of the rollers, ie if the clutches are positioned on the sidepiece 2, said linkage is within the machine sidepiece 1.

The two clutches 41 and 42, of the rollers 6A and 5A respectively, operate alternately in the sense that when one effects engagement the other effects disengagement.

This means that, assuming that the clutch 42 is engaged, the roller 5A moves in the rotational direction 51 and the roller 6A moves in the opposite rotational direction 54, and without involving the toothed pulley 38 as this pulley is freely rotatable for the fact that it is mounted on a support shaft via a bearing (see FIG. 3 for similarity).

Figure 5:
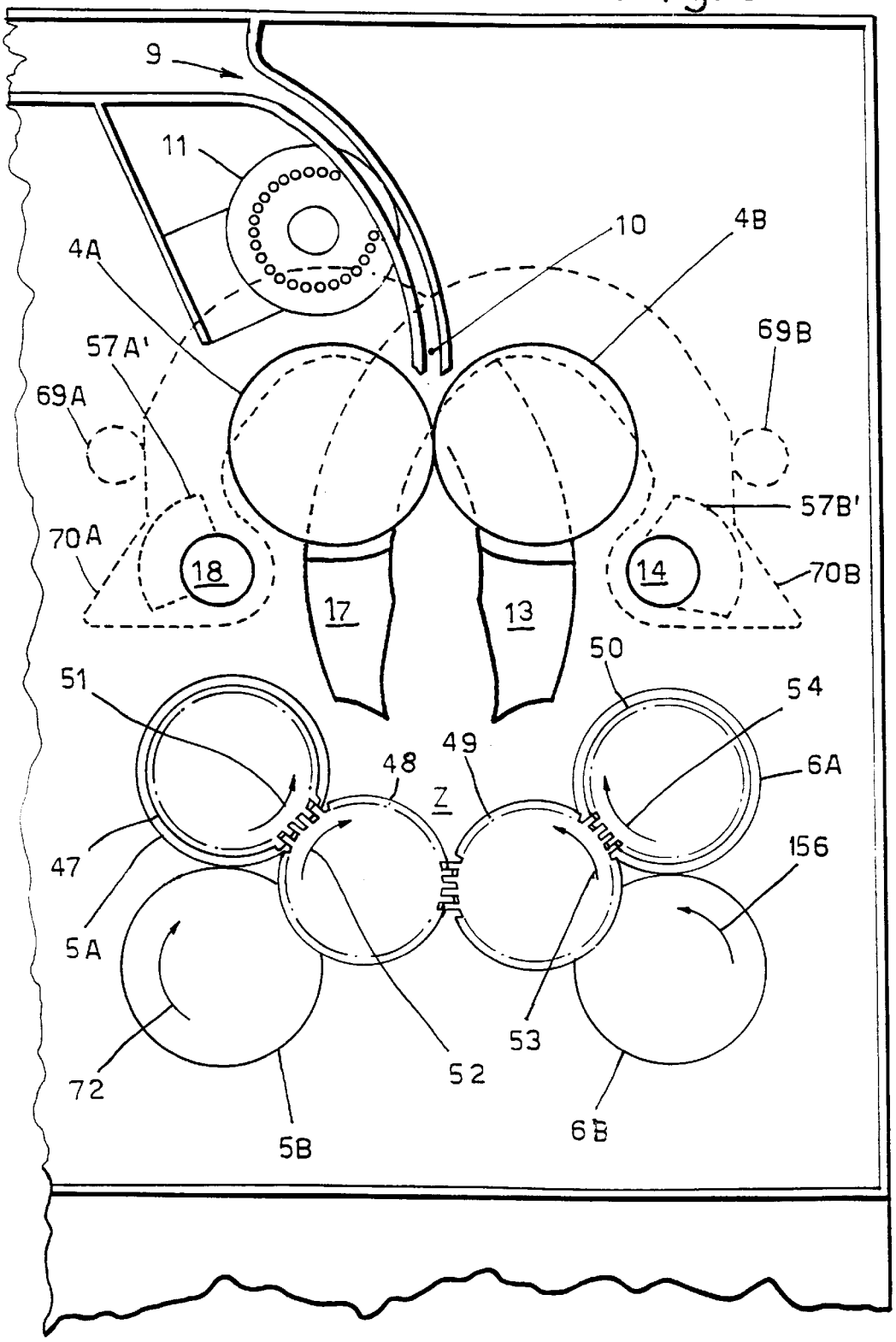
FIG. 5 shows the linkage between the two pairs of folding rollers.

In this respect, analyzing the rotational directions transmitted by the common toothed belt 36 to the two pulleys 37 and 38 cooperating with the rollers 5A and 6A respectively, it can be seen that these rotational directions are identical (FIG. 2), ie incompatible with the opposite rotational directions transmitted by their linkage via the gearwheels 47, 48, 49, 50 (FIG. 5). Hence said upper folding rollers 5A and 6A always rotate in opposite directions.

Each of these rollers is positioned in contact with its own underlying identical idle roller 5B and 6B (FIG. 1) rotating in the directions 156 and 72 respectively.

The roller pairs 5A–5B and 6A–6B therefore rotate in the aforesaid directions.

All these four rollers 5A, 5B, 6A, 68 are cylindrical and are coated externally with rubber, so that contact between the upper roller 5A and the underlying lower roller 5B (and contact between the upper roller 6A and the underlying lower roller 6B) results in drive by friction. Their frictional contact is determined by springs 71 positioned at the two sides to upwardly urge a support crosspiece 56 on which the respective ends 65 and 64 of the of the shafts of the lower rollers 5B and 6B rest (FIG. 2). This elastic bearing contact between the folding rollers also performs the function of maintaining the compressive load on the fold constant notwithstanding small variations in the sheet thickness. On this basis, assuming a rotational direction 51 for the roller 5A, the driven roller 5B has a rotational direction 72, and the other roller driven by 6A has a rotational direction 156, which is concomitant with the rotational direction 54 (FIG. 5).

This concomitance means that a paper sheet which from the central region Z makes contact with the rubberized surfaces of the rollers 5A–5B (or the rollers 6A–6B) would be pushed away by friction by these pairs of rollers and returned or expelled towards said central region Z.

If however these concomitant rotational directions for each specific roller pair were the opposite to those considered, as soon as a paper sheet made contact with the surfaces of these four rubberized rollers 5A–5B, 6A–6B facing said central region Z, this sheet would be immediately dragged between one of said pairs of rollers, which would hence exert a calendering action on it, and compress it.

If this sheet were already partially folded to V-shape and were inserted between the pair of rollers with its vertex facing between them, then said compression would be exerted on said pre-fold, which would in this manner become completely flattened and perfected.

This is what the machine of the invention proposes to achieve, for which purpose it is equipped with appropriate pre-folding means and means for achieving complete, folding, implemented by compression exerted by the roller pairs 5A–5B or 6A–6B.

Said pre-folding means are the already described sharp creasing blades 13 and 17.

These blades and the rollers 5A and 6A are subjected to brief operational angular rotations followed by angular return rotations to their rest position. The blades 13 and 17 are returned by the return springs 16 and 19. The "return" of the rollers to their initial angular position for drawing-in and compressing the pre-fold is achieved by the rigidity of the already described linkage, after reversing the directions of rotation. In this respect, this expulsion stage must also be coordinated with the feed of the descending paper sheet, from which the linear distance between two adjacent folds depends, and must therefore be included in the overall operating program.

The aforegoing highlights the substantial operational difference between the "returns" of the creasing blades and the and "returns" of the compressing or folding rollers, this difference conceptually enabling specific pulsating means, such as electromagnetic angular actuators, usually known as "solenoid actuators", to be used. In said actuators, the angular rotation is determined by the creation of a magnetic field by passing current through a coil and its cooperation with an iron attraction element. In FIGS. 1 and 5, these solenoid actuators, indicated by 57A, 57B, are mounted at the end of the oscillation pins or shafts 14 and 18 and provide angular travel of less than one quarter of a revolution (deducible from the dashed shape indicated in FIG. 5).

If for special requirements the return travel of said solenoid actuators is to be electrically or programmably controlled, they could be of double-acting type, ie with their return no longer dependent on return springs but on specific electromagnetic pulses.

As an alternative to this, the same linkages already illustrated with regard to the forward and rearward angular rotation defining the movement of thee folding rollers 5A and 6A could be applied to the pins or shafts 14 and 18.

FIG. 5 shows the constructional details of the creasing blades 13 and 17. Specifically, 57A' and 57B' show the angular sector shapes indicating the travel (less than 90°) provided by the operation of the solenoid actuators indicated by said numerals. 69A and 69B indicate sensors or microswitches operated by end cams 70A, 70B positioned at the end of the lateral supports (indicated by dashed lines) for the creasing blades 13 and 17.

Figure 7:
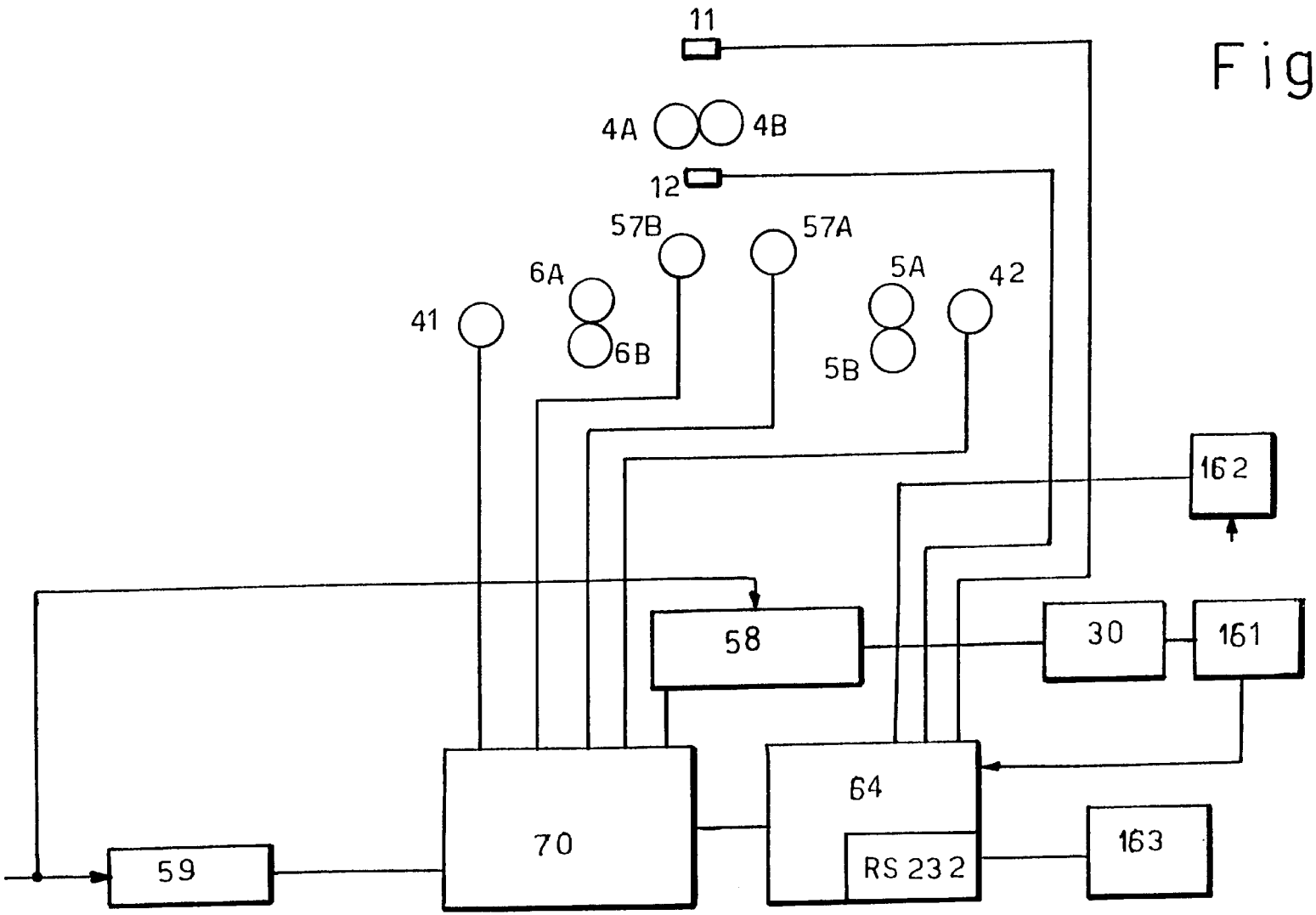
FIG. 7 is a block diagram showing the various operative parts.

FIG. 7 shows the interdependence between said various machine parts 4A, 4B, 5A, 5B, 6A, 6B, 11, 12, 30, 41, 42, 57A, 57B and the following electronic control equipment:

161=encoder connected to the shaft of the motor 30;

162=keyboard for selecting the sheet format and for expelling the paper in an emergency;

163=facility for a removable keyboard to be used during setting-up and connectable via a serial RS232 port to the microprocessor;

64=microprocessor with the sensors 11 and 12 and the signals of the encoder 161 as inputs; the two keyboards 162 and 163 are connectable to this microprocessor;

58=motor operation controls;

59=possible electrical transformer for low voltage powering of the electronic card 70;

70=electronic card controlling the power members providing electrical feed to the motor operation controls, the microprocessor 64, the clutches an the solenoid actuators.

In this diagram the motor 30 is considered to be of direct current type; it could however be of stepping type controlled by its own operating card. If however a synchronous motor is used, this would be controlled directly by the power card 70, in which case neither the operating controls 58 nor the encoder 161 would be required.

FIG. 8 shows a direct comparison between the actions (each action indicated by a raising of the line) of the various specified machine parts during the implementation of the folding cycle. These parts are indicated by the same numbers already used, ie the two sensors 11 and 12, the motor 30, the two solenoid actuators 57A and 57B controlling the creasing blades, and the two electromagnetic clutches 41 and 42 operating the two pairs of folding rollers.

In this diagram the times are indicated by a capital T associated with a number. On this basis, as soon as the sensor 11 senses the sheet to be folded, the motor 30 starts. The sensor "sees" the sheet with a short delay. From this moment electronic step counting commences, for forming the fold to the desired length (T2).

On termination of the count T2 the folding stage commences, which concludes at the end of times T5 and T6 for the actuator 57B, and at the end of times T11 and T12 for the actuator 57A.

On termination of the folding stage, the paper advances for the next fold and the cycle continues until the sensor 11 fails to sense the presence of the sheet 23. After this the motor automatically stops.

In the said time diagram of FIG. 8, the parameters shown have the following meanings.

T2 defines the length of the fold, with the clutch 42 activated;

T3 defines the activation advance of the solenoid actuator 57B;

T4 defines the duration of activation of the solenoid actuator 57B;

T5 defines the delay before reactivation of the solenoid actuator 57B;

T6 defines the duration of reactivation of said actuator 57B;

T7 defines the delay before activation of the clutch 41;

T8 defines the duration of activation of the clutch 41;

T9 defines the activation advance of the solenoid actuator 57A;

T10 defines the duration of activation of the solenoid actuator 57A;

T11 defines the delay before reactivation of the solenoid actuator 57A;

T12 defines the duration of reactivation of the solenoid actuator 57A.

I claim:

1. An automatic machine for folding long sheets comprising:

first and second oscillating blades having transverse motion which create alternate creases in a vertically descending sheet and first and second upper folding rollers opposing respective first and second lower folding rollers rotatable with predetermined reciprocating synchronous movement, said first and second oscillating blades being arranged to insert said sheet between said folding rollers to form folds in the sheet, whereby the folded sheet is directed towards an underlying collection shelf said upper folding rollers being driven with rapid-reversal or pulse-reversal rotation by a linkage which moves them in the same direction by virtue of their connection by a toothed drive belt, engaged about toothed end pulleys which are rotatably free, but which can be individually and alternately fixed to a shaft of their own respective roller following the operation of an electromagnetic clutch, said first upper folding roller being connected to said second upper folding roller by a series of gearwheels causing said first and said second upper folding rollers to rotate in opposite directions.

2. A machine as claimed in claim 1, characterised in that the oscillating blades (13, 17) creasing transverse to the descending movement of the sheet (23) comprise profiled lateral support parts (13B, 17B) oscillating external to the overall outline of downward feed rollers (4A, 4B) and sharp creasing parts (13A, 17A) supported by their ends and operating alternately between the two pairs of folding rollers (5A–5B, 6A–6B) such that one part (for example 17A) introduces a pre-fold in the sheet between said folding rollers (5A–5B) when these are rotated in directions which draw the sheet between them, and leaves space by its return movement for the other sharp creasing part (for example 13A) during the subsequent expulsion of the completed fold, said other sharp creasing part being in this manner able to cooperate by action analogous and symmetrical to the preceding with the other specific pair of folding rollers (6A–6B).

3. A machine as claimed in claim 2, characterised by pulse movements transmitted to the blades by electromagnetic solenoid actuators (57A, 57B).

4. A machine as claimed in claim 2, characterised by creasing blades (13, 17) returned to a rest position by appropriate springs (16, 19).

5. A machine as claimed in claim 1, characterised by a belt (36) driving the upper folding rollers (5A, 6A) via a toothed pulley (35) coaxial and rigid with a gearwheel (34) driven by a drive gearwheel (32) via an intermediate idle gearwheel, the purpose of said intermediate gearwheel being to rotate its shaft (55) on which there is keyed in cascade a gearwheel (60) from which there is derived the motion required to continuously drive the central paper feed rollers (4A, 4B), by means of a gearwheel (63) keyed onto one of them, said derivation being achieved by a suitable pair of idle gearwheels (61, 62).

6. A machine as claimed in claim 5, characterised by a gearwheel (63) which directly drives its own paper feed roller (4B) and indirectly drives the other paper feed roller (4A), said other roller (4A) being elastically urged thereagainst by springs acting on their own traditional supports to achieve contact between the rollers (4A, 4B) and generate the necessary dragging friction by means of a rubber coating present on both rollers (4A, 4B).

7. A machine as claimed in claim 1, characterised by upper folding drive rollers having rubber coatings (5A, 6A) which by friction generated between their rubber coatings drag their own underlying cooperating rollers (5B, 6B) in a concomitant rotational direction (65, 56; 51, 72), said friction being derived from contact achieved by a spring (71) which via a common crosspiece (56) urges two supports for shafts (64, 65) rotating said cooperating rollers (5B, 6B).

* * * * *